US005624234A

United States Patent [19]

Neely et al.

[11] Patent Number: 5,624,234

[45] Date of Patent: Apr. 29, 1997

[54] FAN BLADE WITH CURVED PLANFORM AND HIGH-LIFT AIRFOIL HAVING BULBOUS LEADING EDGE

[75] Inventors: Michael J. Neely, Dayton; John R. Savage, Kettering, both of Ohio

[73] Assignee: ITT Automotive Electrical Systems, Inc., Auburn Hills, Mich.

[21] Appl. No.: 471,270

[22] Filed: Jun. 6, 1995

Related U.S. Application Data

[63] Continuation-in-part of Ser. No. 342,358, Nov. 18, 1994.

[51] Int. Cl.[6] ..... F04D 29/38

[52] U.S. Cl. ..... 416/238; 416/189; 416/242

[58] Field of Search ..... 416/238, 189 R, 416/169 A, 242

[56] References Cited

U.S. PATENT DOCUMENTS

| | | | |
|---|---|---|---|
| 1,129,934 | 3/1915 | Wiedling | 416/238 |
| 1,323,102 | 11/1919 | Roberts | 416/238 |
| 2,157,999 | 7/1939 | Charavay . | |
| 2,682,925 | 7/1954 | Wosika | 416/242 |
| 3,333,817 | 8/1967 | Rhomberg | 416/223 A |
| 4,073,601 | 2/1978 | Kress | 416/242 |
| 4,135,858 | 1/1979 | Entat . | |
| 4,358,245 | 11/1982 | Gray . | |
| 4,548,548 | 10/1985 | Gray, III | 416/189 R |
| 4,569,631 | 2/1986 | Gray, III . | |
| 4,569,632 | 2/1986 | Gray, III . | |
| 4,684,324 | 8/1987 | Perosino | 416/238 |
| 4,685,513 | 8/1987 | Longhouse et al. . | |
| 4,692,098 | 9/1987 | Razinsky et al. . | |
| 4,840,541 | 6/1989 | Sakane et al. . | |
| 4,871,298 | 10/1989 | Vera . | |
| 4,900,229 | 2/1990 | Brackett et al. . | |
| 4,915,588 | 4/1990 | Brackett . | |
| 4,930,984 | 6/1990 | Kesel et al. . | |
| 4,971,520 | 11/1990 | Van Houten . | |
| 5,000,660 | 3/1991 | Van Houten et al. . | |
| 5,064,345 | 11/1991 | Kimball . | |
| 5,151,014 | 9/1992 | Greenwald et al. . | |
| 5,169,290 | 12/1992 | Chou . | |
| 5,193,981 | 3/1993 | Scheidel et al. . | |
| 5,197,854 | 3/1993 | Jordan . | |
| 5,221,187 | 6/1993 | Lorea et al. . | |
| 5,244,347 | 9/1993 | Gallivan et al. . | |
| 5,320,493 | 6/1994 | Shih et al. . | |
| 5,326,225 | 7/1994 | Gallivan et al. . | |
| 5,342,167 | 8/1994 | Rosseau . | |
| 5,354,178 | 10/1994 | Ferleger et al. | 416/223 A |
| 5,393,199 | 2/1995 | Alizaden . | |
| 5,399,070 | 3/1995 | Alizaden . | |
| 5,454,695 | 10/1995 | Shah et al. | 416/238 |

FOREIGN PATENT DOCUMENTS

| | | | |
|---|---|---|---|
| 0482788 | 4/1992 | European Pat. Off. | 416/238 |
| 410800 | 9/1923 | Germany . | |
| 3640780 | 10/1988 | Germany . | |
| 4326147 | 11/1994 | Germany . | |

OTHER PUBLICATIONS

International Search Report dated Apr. 25, 1996.

*Primary Examiner*—Edward K. Look
*Assistant Examiner*—Mark Sgantzos
*Attorney, Agent, or Firm*—Thomas N. Twomey; J. Gordon Lewis

[57] ABSTRACT

A blade for a vehicle engine-cooling fan assembly having a curved planform and a high-lift airfoil. The planform has a first region adjacent the root of the blade with forward curvature, a second region adjacent the tip of the blade with backward curvature, and an intermediate region disposed between the first region and the second region with substantially straight curvature. The airfoil has a leading edge; a rounded, bulbous nose section adjacent the leading edge; a trailing edge; a curved pressure surface extending smoothly and without discontinuity from the nose section to the trailing edge; a curved suction surface extending smoothly and without discontinuity from the nose section to the trailing edge; and a thin, highly cambered aft section formed adjacent the trailing edge and between the pressure surface and the suction surface. The nose section has a thickness which is greater than the thickness of the airfoil between the pressure surface and the suction surface and the nose section blends smoothly into the pressure surface and the suction surface.

20 Claims, 14 Drawing Sheets

FAN BLADE WITH CURVED PLANFORM AND HIGH-LIFT AIRFOIL HAVING BULBOUS LEADING EDGE

This is a continuation-in-part of U.S. patent application Ser. No. 08/342,358 filed on Nov. 18, 1994.

FIELD OF THE INVENTION

This invention relates generally to a vehicle engine-cooling fan assembly and, more particularly, to the fan blade of such an assembly. The fan blade combines a curved planform with a high-lift airfoil having a bulbous nose adjacent its leading edge which smoothly merges into both the pressure and suction surfaces of the airfoil.

BACKGROUND OF THE INVENTION

A multi-bladed cooling air fan assembly 10 (which incorporates the present invention) is shown in FIG. 1. Designed for use in a land vehicle, fan assembly 10 induces air flow through a radiator to cool the engine. Fan assembly 10 has a hub 12 and an outer, rotating ring 14 that prevents the passage of recirculating flow from the outlet to the inlet side of the fan. A plurality of blades 100 (seven are shown in FIG. 1) extend radially from hub 12 (where the root of each blade 100 is joined) to ring 14 (where the tip of each blade 100 is joined).

Fan assembly 10 must accommodate a number of diverse considerations. For example, when fan assembly 10 is used in an automobile, it is placed behind the radiator. Consequently, fan assembly 10 must be compact to meet space limitations in the engine compartment. Fan assembly 10 must also be efficient, avoiding wasted energy which directs air in turbulent flow patterns away from the desired axial flow; relatively quiet; and strong to withstand the considerable loads generated by air flows and centrifugal forces.

Generally, blades 100 are "unskewed." Such blades have a straight planform in which a radial center line of blade 100 is straight and the blade chords perpendicular to that line are uniformly distributed about the line. Occasionally, blades 100 are forwardly skewed: the blade center line curves in the direction of rotation of fan assembly 10 as the blade extends radially from hub 12 to ring 14. U.S. Pat. No. 4,358,245, assigned to Airflow Research and Manufacturing Corporation (ARMC), discloses a forwardly skewed fan blade in which the blade angle increases over the outer 30% of the blade.

U.S. Pat. No. 5,393,199 also discloses a fan blade forwardly skewed at least along the portion of the blade adjacent the tip (see column 5, line 55 through column 6, line 44). Each blade has leading and trailing edges which include a portion adjacent the root substantially collinear with the respective radius extending from the center of the fan. In FIG. 8 of the '199 patent, the collinear portions are represented by X1, X2, and X3.

Other blades 100 are backwardly (away from the direction of fan rotation) skewed. General Motors Corporation has used a fan blade with a modest backward skew on its "X-Car." The blade angle of that fan blade increases with increasing diameter along the outer portion of the blades and the skew angle at the blade tip is about 40° . U.S. Pat. No. 4,569,632, assigned to ARMC, discloses an axial flow fan with blades that are increasingly backward-skewed as a function of movement from hub to ring. The blades are oriented at a pitch ratio which continuously decreases as a function of increasing blade radius along the radially outermost 30% of the blade.

Still other blades 100 are backwardly skewed in the root region of the blade adjacent the hub of fan assembly 10 and forwardly skewed in the tip region of the blade. U.S. Pat. No. 4,569,631 (also assigned to ARMC); No. 4,684,324; and No. 5,064,345 each disclose such a blade. Each of these references teach a short, abrupt transition region (if any) between the root region of backward skew and the tip region of forward skew. For example, the '345 patent specifically discloses a transition region of no greater than 0.01 R, where R is the fan radius.

To improve the operation of fan assembly 10, much attention has focused on the design or shape of the blade airfoils. High lift and efficiency are required to meet the ever-increasing operational standards for vehicle engine-cooling fan assemblies. There are many different airfoil shapes and slight variations in shape alter the characteristics of the airfoil in one way or another.

Because only slight variations in airfoil design yield large differences in aerodynamic performance, a multitude of different airfoils were developed by approximately 1920. At that time, there was no orderly system of identifying the different airfoils. Those that seemed to prove effective were simply given arbitrary designations such as RAF 6, Gottingen G-398, and Clark Y.

The National Advisory Committee for Aeronautics (NACA), which was the forerunner of NASA, developed an identification system in the late 1920s. NACA's wind tunnel tests showed that the aerodynamic characteristics of airfoils depend primarily upon two shape variables: the thickness form and the mean-line form. NACA then proceeded to identify these characteristics in a numbering system for the airfoils.

The first such airfoils are referred to by the NACA four-digit series. The NACA 2412 airfoil is a typical example. The first number (2 in this case) is the maximum camber in percent (or hundredths) of chord length. The second number, 4, represents the location of the maximum camber point in tenths of chord and the last two numbers, 12, identify the maximum thickness in percent of chord. All characteristics are based on chord length (c) because they are all proportional to the chord. For this airfoil, the maximum camber is 0.02 c, the location of maximum camber is 0.4 c, and the maximum thickness is 0.12 c.

The flat plate 20, shown in FIG. 2*a* in an air stream 18, is the simplest of airfoils. At zero angle of attack ($\alpha$), flat plate 20 produces no lift because it is actually a symmetrical airfoil (it has no camber). At a slightly positive angle of attack, however, flat plate 20 will produce lift, as shown in FIG. 2*b*. Flat plate 20 is not a very efficient airfoil because it creates a fair amount of drag. The sharp leading edge 22 also promotes stall at a very small angle of attack and, therefore, severely limits the lift-producing ability of flat plate 20. The stall condition is illustrated in FIG. 2*c*.

For these reasons, airfoils were provided with a curved nose adjacent the leading edge. That modification enables the airfoil to achieve higher angles of attack without stalling. Such an airfoil is efficient, however, only over a small range of angles. Accordingly, the curved nose was filled in so that a wider range of angles of attack was possible. These thicker airfoils displayed greater lifting capability and finally evolved into the shape shown in FIGS. 3*a* and 3*b*, recognized as the "typical" or "classic" thicker airfoil 30.

FIG. 3*a* illustrates the conventional thicker airfoil 30 having a leading edge 32, a trailing edge 34, and substantially parallel surfaces 36 and 38. The chord of thicker airfoil 30 is the straight line (represented by the dimension "c")

extending directly across the airfoil from leading edge 32 to trailing edge 34. The camber is the arching curve (represented by the dimension "a") extending along the center or mean line 40 of thicker airfoil 30 from leading edge 32 to trailing edge 34. Camber is measured from a line extending between the leading and trailing edges of the airfoil (i.e., the chord length) and mean line 40 of thicker airfoil 30.

As shown in FIG. 3*b*, when thicker airfoil 30 contacts a stream of air 18, the air stream engages leading edge 32 and separates into streams 42 and 44. Stream 42 passes along surface 36 while stream 44 passes along surface 38. As is well known, stream 42 travels a greater distance than stream 44, at a higher velocity, with the result that air adjacent to surface 36 is at a lower pressure than air adjacent to surface 38. Consequently, surface 36 is called the "suction side" of thicker airfoil 30 and surface 38 is called the "pressure side" of thicker airfoil 30. The pressure differential creates lift.

Airfoils with the classic profile of thicker airfoil 30 illustrated in FIGS. 3*a* and 3*b* have been used in engine-cooling fan assemblies. Such airfoils improved fan efficiency relative to contemporary, competing airfoil profiles. They have been unable, however, to provide the higher lift-to-drag ratios now desired for automotive applications. High lift and increased efficiency are needed to meet higher operational standards for vehicle engine-cooling fan assemblies. Accordingly, additional airfoil designs have been developed.

U.S. Pat. No. 5,151,014, assigned to ARMC, discloses an airfoil having a reduced, substantially constant thickness over most of its chord length. Accordingly, the ARMC airfoil 50 (see FIGS. 4*a*, 4*b*, and 4*c* which correspond to FIGS. 2*a*, 2*b*, and 3, respectively, in the '014 patent) is lighter than thicker airfoil 30 and, ostensibly, offers increased efficiency. ARMC airfoil 50 has a leading edge 52, a trailing edge 54, and substantially parallel suction surface 56 and pressure surface 58.

Pressure surface 58 has a first sharp corner 60, such that pressure surface 58 diverges or bends towards suction surface 56, thereby creating a thick nose section 62 and a reduced thickness portion 64. The distance between corner 60 and leading edge 52 is between 5% and 10% of the chord length of ARMC airfoil 50. Pressure surface 58 also has a second sharp corner 61 upon termination of straight line portion 59 of pressure surface 58. The dashed line 66 in FIGS. 4*a* and 4*b* illustrates the pressure surface of thicker airfoil 30.

FIG. 4*b* illustrates the flow of air over ARMC airfoil 50. A stream of air 18 intersects ARMC airfoil 50 at leading edge 52 and separates into streams 68 and 70. Stream 68 flows along suction surface 56. Stream 70 may not flow, however, along pressure surface 58. According to the '014 patent, stream 70 will separate from pressure surface 58 at corner 60 and will follow a path similar to the path followed by stream 44 for thicker airfoil 30 shown in FIG. 3*b*. Therefore, ARMC airfoil 50 appears to have substantially the same flow characteristics as thicker airfoil 30.

To assure that stream 70 separates from pressure surface 58, the angle at which pressure surface 58 diverges at corner 60 must be greater than a threshold angle. If the bend is too gradual, stream 70 will turn at corner 60 and remain close to pressure surface 58—resulting in increased loading and noise. Referring to FIG. 4*c*, corner 60 bends at an angle θ of at least 30°. Angle θ is measured between lines tangent to pressure surface 58 on each side of corner 60. Although the air flow disclosed in the '014 patent may occur, it is unnecessary for the design of a high-lift, lightweight airfoil.

U.S. Pat. No. 4,692,098, assigned initially to General Motors Corporation, discloses an airfoil shaped for improved pressure recovery. In this design, a discontinuity in the form of a flat, step, scribe mark, cavity, or surface roughness is made on the suction surface 86—rather than on the pressure surface 88—of the discontinuous airfoil 80 of the '098 patent (see FIG. 5 which corresponds to FIG. 4 in the '098 patent). Preferably, a flat 82 transverse to the chord of discontinuous airfoil 80 and adjacent to the airfoil nose 84 is provided on suction surface 86. Flat 82 extends rearward from a sharp edge 94 that is located toward the forward end of the laminar boundary layer region. Flat 82 forms a ramp that makes a 9° angle with a tangent line 96 to the upstream suction surface 86 of discontinuous airfoil 80. Discontinuous airfoil 80 also has a rounded leading edge 90, a trailing edge 92, and a so-called Stratford recovery region that connects flat 82 to trailing edge 92.

Discontinuous airfoil 80 is designed to control the size and location of the laminar separation bubble that forms on suction surface 86 as the airfoil operates in a low-Reynolds-number environment. Airfoils of this type are very effective at reducing the size of the laminar separation bubble and ensuring the re-attachment of flow on suction surface 86. By controlling the separation and re-attachment in this manner, discontinuous airfoil 80 operates at a high lift-to-drag ratio.

Airfoils like discontinuous airfoil 80 have been used for many years in engine-cooling fan assemblies on General Motors vehicles. On an airfoil with a straight planform, a discontinuous airfoil 80 with a flat 82 provides excellent performance across a wide operating range. On the new, backward-curved blades used (for example) in the air conditioning systems without chlorinated fluorocarbons (CFCs), however, discontinuous airfoil 80 is not as effective as an airfoil with a smooth, continuous suction surface.

To overcome the shortcomings of conventional fan assemblies, a new fan assembly is provided. An object of the present invention is to provide an engine-cooling fan assembly, including a plurality of blades, having operational and air-pumping efficiency. Another object is to provide an improved fan assembly having a compact configuration. Still another object of the present invention is to reduce the noise created by the fan assembly. It is still another object of the present invention to reduce the axial depth of the ring of the fan assembly.

Blades produce turning of the air stream through the fan assembly, thereby creating a pressure rise across the assembly. Yet another object of the present invention is to provide a fan assembly in which the fan blades combine a curved planform with a high-lift airfoil. The airfoil of the fan blades has a bulbous nose adjacent its leading edge which smoothly merges into both the pressure and suction surfaces of the airfoil. A related object is to provide a blade in an engine-cooling fan assembly that provides high pressure rise across the fan assembly and reduced mass. Finally, it is an object of the present invention to provide a blade design suitable for the entire range of engine-cooling fan assembly operation, including idle.

SUMMARY OF THE INVENTION

To achieve these and other objects, and in view of its purposes, the present invention provides a blade (for a vehicle engine-cooling fan assembly) having a curved planform and a high-lift airfoil. The planform has a first region adjacent the root of the blade with forward curvature, a second region adjacent the tip of the blade with backward curvature, and an intermediate region disposed between the first region and the second region with substantially straight curvature. The airfoil has a leading edge; a rounded, bulbous nose section adjacent the leading edge; a trailing edge; a curved pressure surface extending smoothly and without discontinuity from the nose section to the trailing edge; a curved suction surface extending smoothly and without discontinuity from the nose section to the trailing edge; and a thin, highly cambered aft section formed adjacent the trailing edge and between the pressure surface and the suction surface. The nose section has a thickness which is greater than the thickness of the airfoil between the pressure surface and the suction surface and the nose section blends smoothly into the pressure surface and the suction surface.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing, in which.

DETAILED DESCRIPTION OF THE INVENTION

Figure 1:
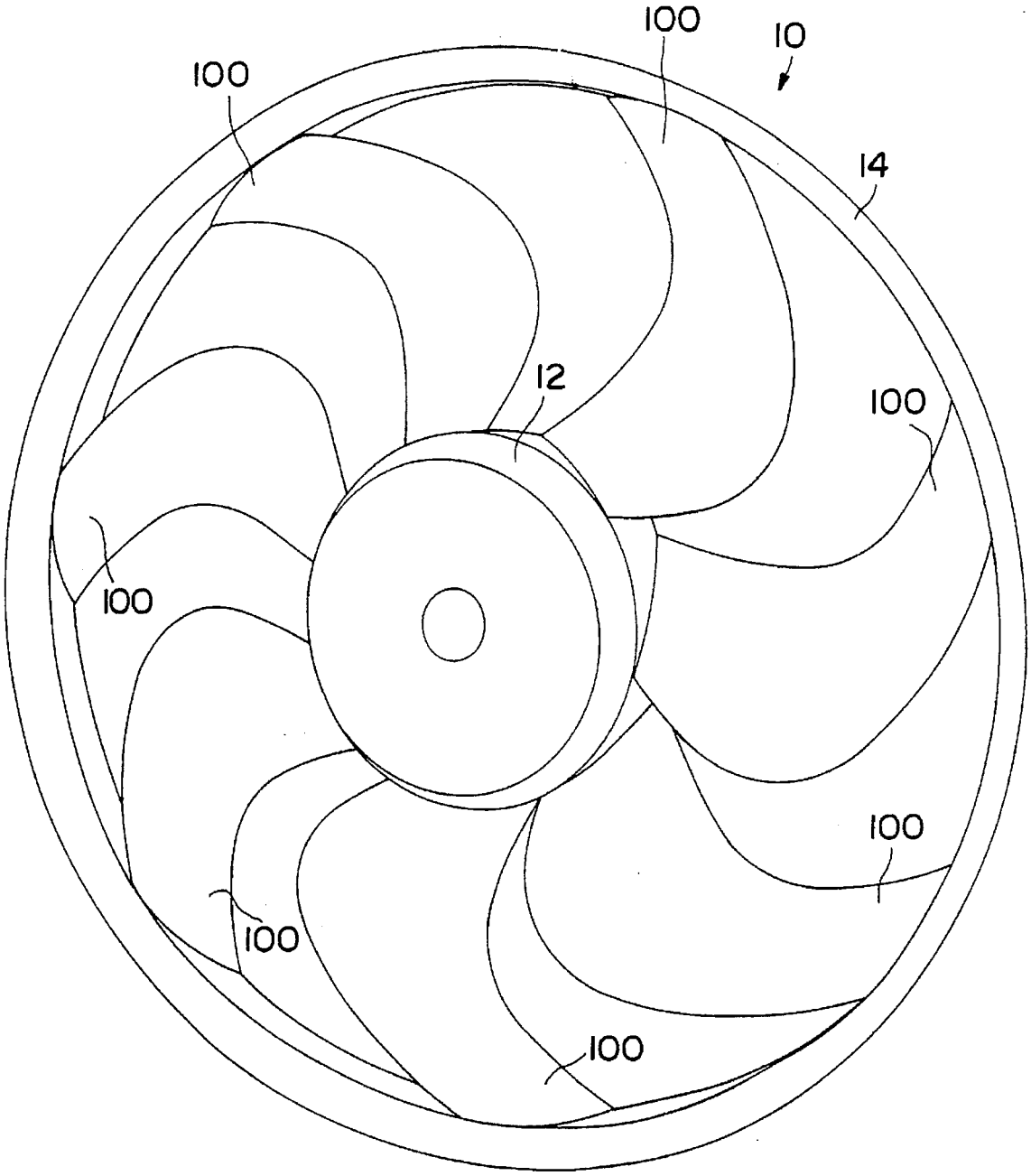
FIG. 1 is a front elevational view of a multibladed cooling air fan assembly incorporating blades having the airfoil and planform of the present invention.
Figure 2A:
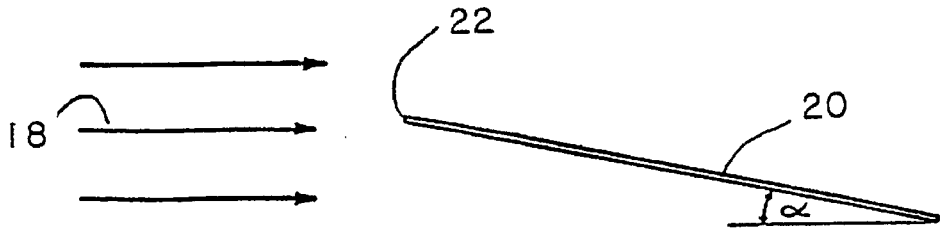
FIG. 2a (PRIOR ART)
FIG. 2*a* illustrates a conventional flat plate airfoil in an airstream.
Figure 2B:
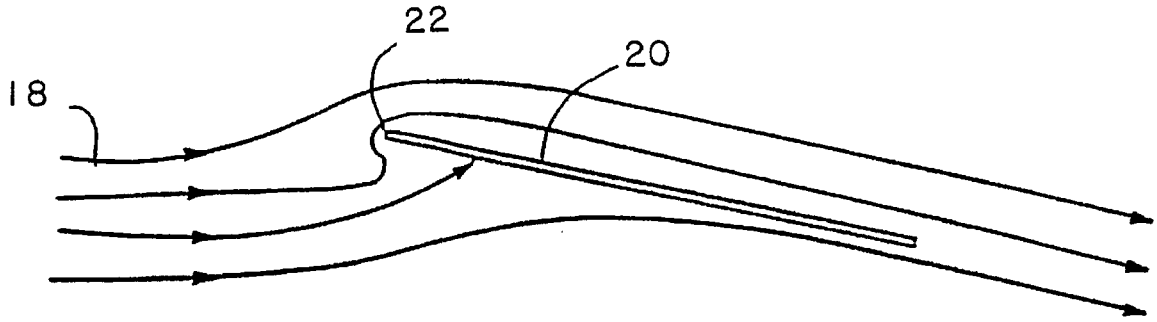
FIG. 2b (PRIOR ART)
FIG. 2*b* is the flat plate airfoil illustrated in FIG. 2*a* showing the airstream at a slight angle of attack.
Figure 2C:
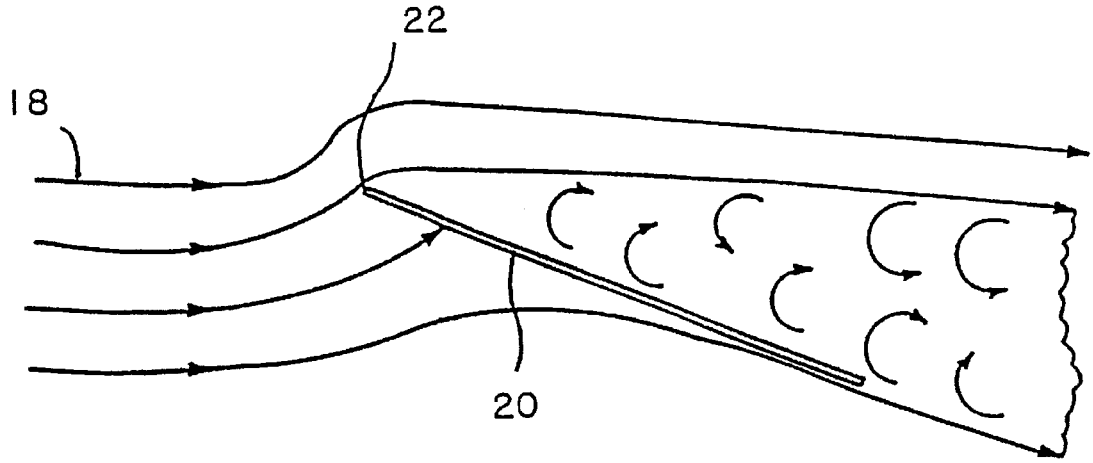
FIG. 2c (PRIOR ART)
FIG. 2*c* is the flat plate airfoil illustrated in FIG. 2*a* during a stalled condition.
Figure 6:
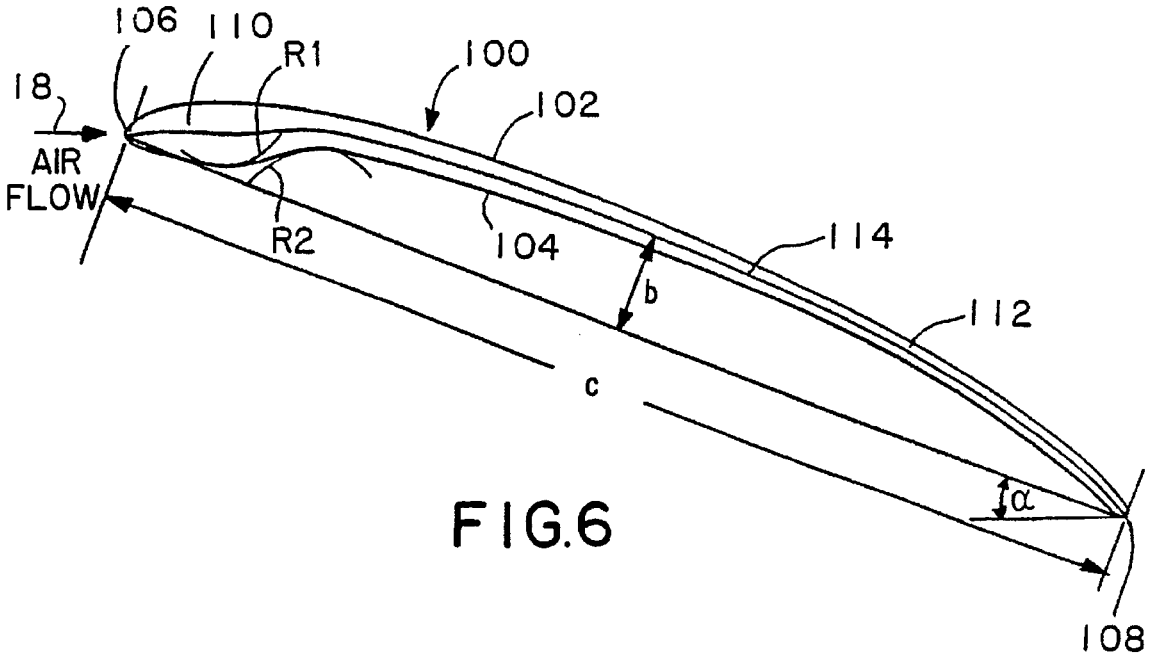
FIG. 6 is a cross-sectional view of the airfoil of the blade of the present invention.

Referring now to the drawing, FIG. 6 shows the airfoil of blade 100 according to the present invention. Blade 100 is used in an engine-cooling fan blade assembly 10 (see FIG. 1). It is emphasized that, according to common practice, the various features of the drawing are not to scale. On the contrary, the width or length and thickness of the various features are arbitrarily expanded or reduced for clarity.

The airfoil of blade 100 has a suction surface 102 and a pressure surface 104 which meet at the leading edge 106 and the trailing edge 108. A rounded, thick, bulbous nose section 110 merges smoothly with the thin, highly-cambered aft section 112 on both suction surface 102 and pressure surface 104. There are no discontinuities or abrupt changes on either suction surface 102 or pressure surface 104.

The airfoil of blade 100 presents an angle of attack ($\alpha$) with air stream 18. Rounded, thick, bulbous nose section 110 prevents separation as the air traverses the airfoil of blade 100 from leading edge 106 to trailing edge 108. The camber of the airfoil of blade 100 is the arching curve (represented by the dimension "b") extending along the center or mean line 114 from leading edge 106 to trailing edge 108. Thin aft section 112 provides high camber and, consequently, high lift. The camber at the location of maximum camber of aft section 112 is between 5 and 12% of the chord.

Figure 3A:
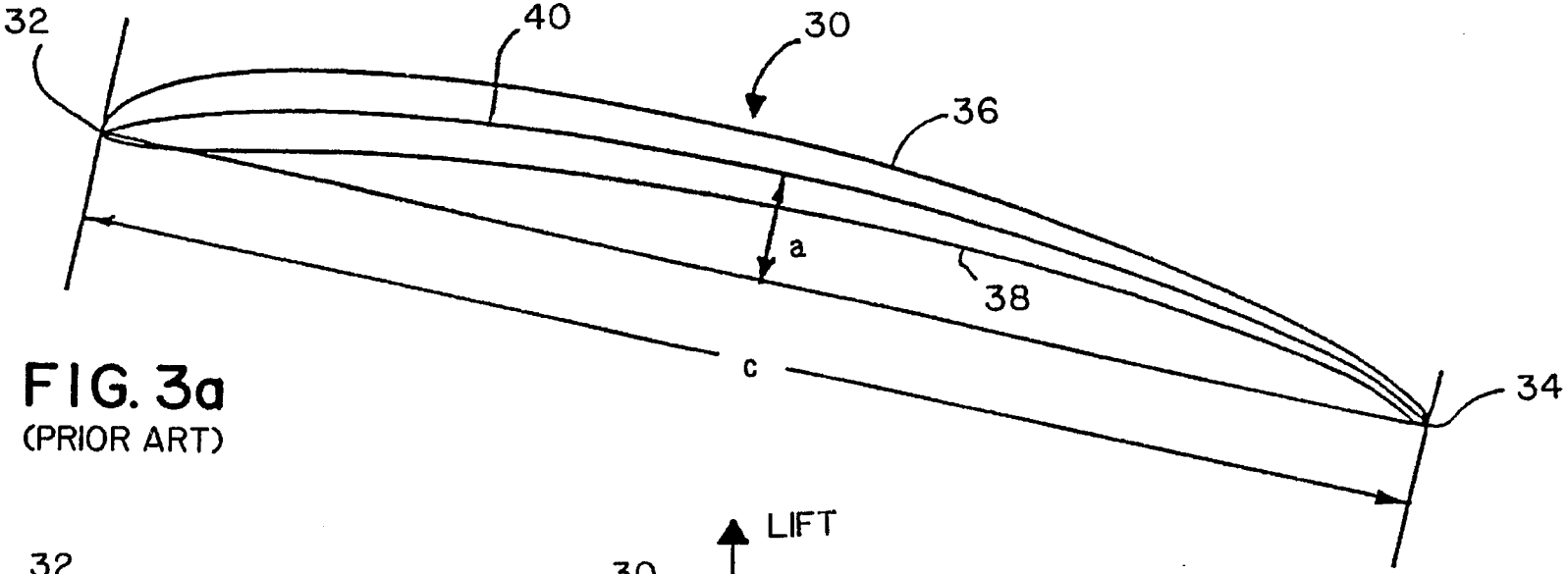
FIG. 3a (PRIOR ART)
FIG. 3*a* is a cross-sectional view of a conventional thicker airfoil.
Figure 3B:
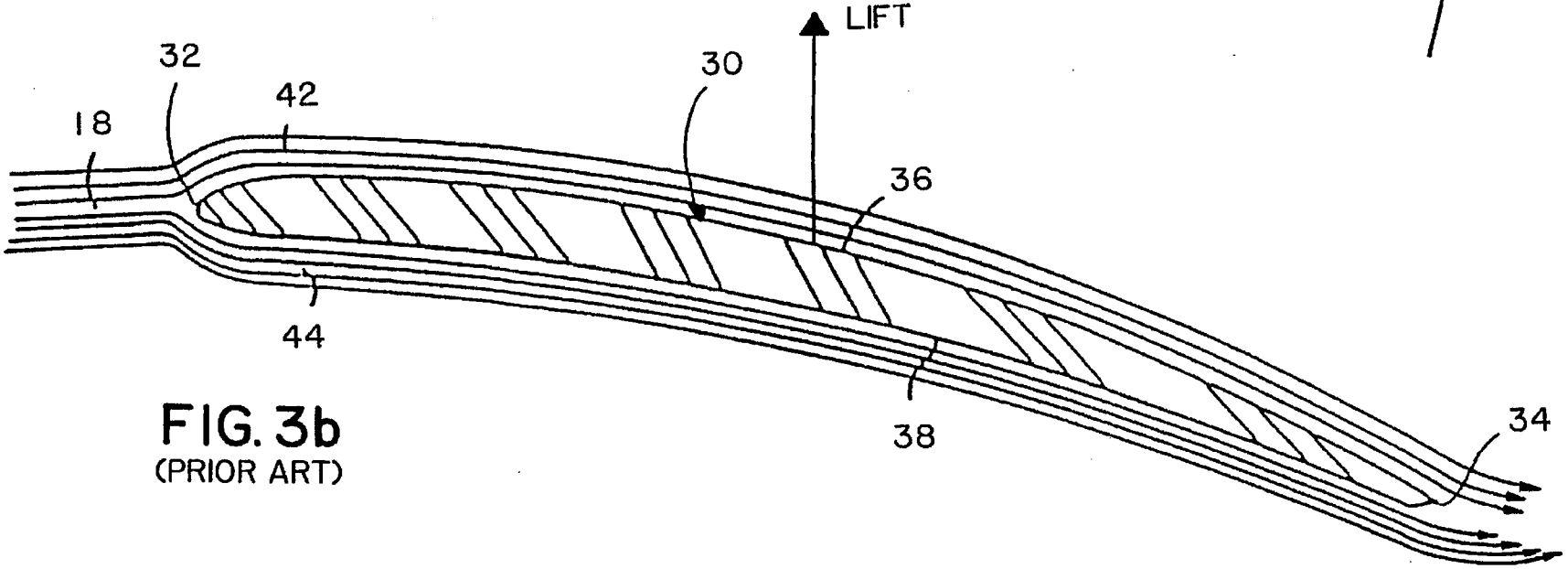
FIG. 3b (PRIOR ART)
FIG. 3*b* illustrates the conventional thicker airfoil, shown in FIG. 3*a*, in an airstream.
Figure 7:
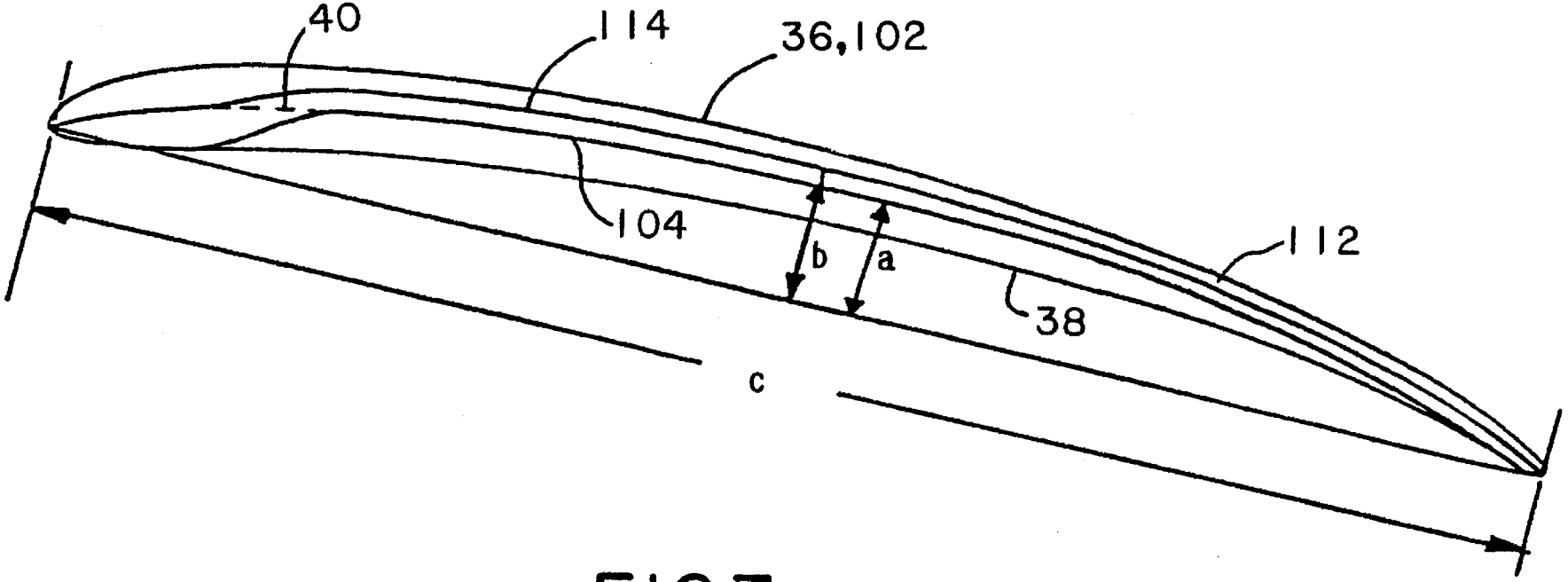
FIG. 7 is a comparison between the thicker airfoil shown in FIG. 3*a* and the airfoil of the blade of the present invention shown in FIG. 6.

As shown in FIG. 7, which presents a comparison between thicker airfoil 30 of FIG. 3*a* and the airfoil of blade 100 of FIG. 6 (via an overlay of the airfoil of blade 100 on thicker airfoil 30), material is removed from pressure surface 104 of the airfoil of blade 100 relative to thicker airfoil 30. Such material removal shifts the mean line of the airfoil upward (compare mean line 40 of thicker airfoil 30 with mean line 114 of the airfoil of blade 100) and increases the camber (b>a). Mean line 40 of thicker airfoil 30 is confluent with pressure surface 104 of the airfoil of blade 100 along most of its length; therefore, thin aft section 112 is about half as thick as the aft section of thicker airfoil 30. Suction surface 36 of thicker airfoil 30 and suction surface 102 of the airfoil of blade 100 coincide.

A quantitative analysis of the comparison illustrated in FIG. 7 was performed. For blades with a chord of approximately 75 mm, the camber at mid-span of thicker airfoil 30 is about 5.7 mm (or 7.7% of chord) while the camber at mid-span of the airfoil of blade 100 is about 6.7 mm (or 8.9% of chord). Thus, b (=6.7 mm) is about 15% larger than a (=5.7 mm) in this example.

The "smooth merging" of rounded, thick, bulbous nose section 110 into pressure surface 104 is achieved, for the embodiment of the invention disclosed, by two blend radii, R1 and R2 (see FIG. 6). R1 forms a convex surface extending from nose section 110 adjacent leading edge 106 of the airfoil of blade 100 and R2 forms a concave surface extending from the convex surface to the remaining pressure surface 104 of the airfoil of blade 100. Large blend radii R1 and R2 assure that the air flow remains attached over the entire pressure surface 104. It is very important that the flow remain attached, to both suction surface 102 and pressure surface 104, to achieve high lift with low noise and low drag. Preferably, R1 and R2 are approximately equal and are no less than about 8% of the chord, c.

For the example airfoil of blade 100 discussed above, having a chord of about 75 mm, R1 and R2 are both slightly less than 10% of chord (R1=7.3 mm or 9.7% of chord; R2=7.2 mm or 9.6% of chord). Rounded, thick, bulbous nose section 110 in that example is about twice as thick as thin aft section 112.

The design combination of rounded, thick, bulbous nose section 110 (which prevents flow separation); smooth merging of nose section 110 into both suction surface 102 and pressure surface 104 (which assures that the air flow remains attached over the entire suction surface 102 and pressure surface 104); and thin aft section 112 (which provides high camber and, consequently, high lift) gives the airfoil of blade 100 a uniquely efficient profile.

The reduced thickness of the airfoil of blade 100 with respect to thicker airfoil 30 (FIG. 7) results, of course, in an airfoil with lower mass. On an experimental blade 100 with the airfoil having the profile described above, blade mass was reduced by about 35% relative to a comparable, thicker blade with airfoil 30. Specifically, blade 100 has a mass of about 19.7 grams while the blade with thicker airfoil 30 has a mass of about 31.9 grams. The reduced mass of blade 100 results, in turn, in a fan assembly 10 with lower mass.

Figure 8:
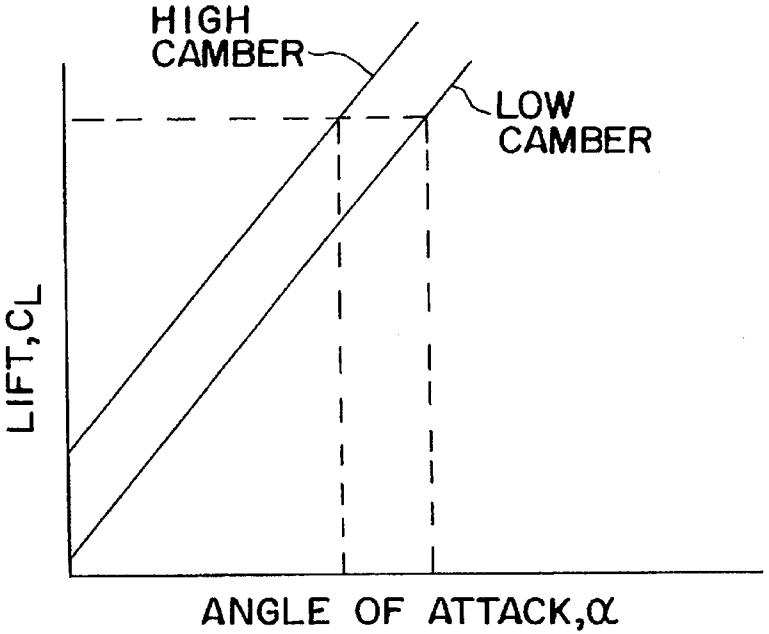
FIG. 8 is a graph of Coefficient of Lift ($C_L$) versus Angle of Attack ($\alpha$) for an airfoil with higher and lower camber.

As discussed above, the airfoil of blade 100 provides higher camber and increased lift verses comparable thick airfoil 30. The high-lift airfoil of blade 100 can be pitched at a lower angle of attack, therefore, to provide the same lift as thicker airfoil 30. This is illustrated by FIG. 8, which is a graph of Coefficient of Lift ($C_L$) versus Angle of Attack ($\alpha$) for an airfoil with higher and lower camber. The efficiency of the airfoil then increases as the angle of attack decreases.

Figure 9B:
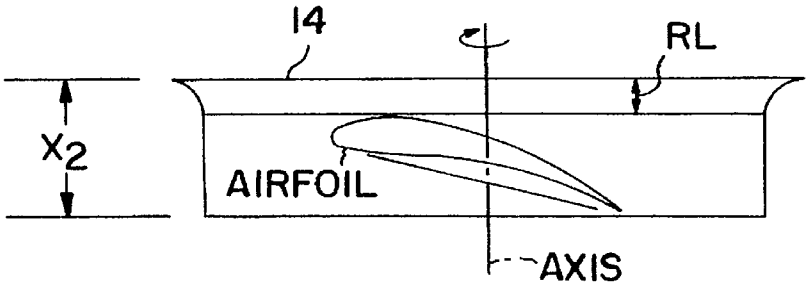
FIG. 9*b* shows the axial depth of the ring of the fan assembly of FIG. 1 when the airfoil has a low angle of attack.
Figure 9A:
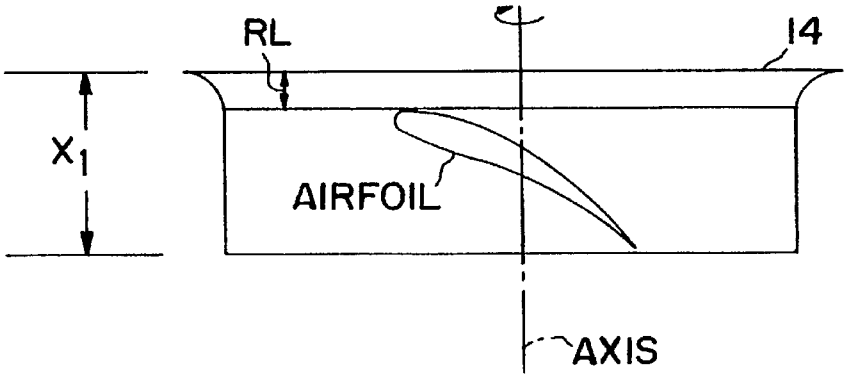
FIG. 9*a* shows the axial depth of the ring of the fan assembly of FIG. 1 when the airfoil has a high angle of attack.

Thus, the improvement in lift provided by the airfoil of blade 100 allows reduction in the attack angle. Reduction of the attack angle permits reduction of the axial depth of ring 14 of fan assembly 10. This advantage is illustrated in FIGS. 9*a* and 9*b* (both figures depict ring 14 rotating clockwise, when ring 14 is viewed from above, around its central axis). FIG. 9*a* shows the axial depth, $x_1$, of ring 14 when the airfoil has a high angle of attack. FIG. 9*b* shows the axial depth, $x_2$, of ring 14 when the airfoil has a lower angle of attack. Clearly, $x_2$ is less than $x_1$. RL is the radius of the ring inlet.

Turning to a specific example, the axial depth of ring 14 when the airfoil has a pitch of about 15.5° is $x_1$=25.4 mm. The axial depth of ring 14 when the airfoil has a pitch of about 13.5° is $x_2$=23.4 mm. Thus, a reduction in axial depth of $x_1-x_2$=2 mm (or about 8%) is achieved. Ring axial depth is calculated as RL+Chord×sin(airfoil pitch angle). The radius of the ring inlet, RL, is about 10 mm in this specific example.

With the airfoil of blade 100 pitched to provide performance equal to the performance of thick airfoil 30 (i.e., at a decreased angle of attack), the reduced axial depth of ring 14 resulted in a decrease of 9% in the mass of ring 14. For the example discussed above, the mass of ring 14 was reduced by about 7.3 grams (from about 81 grams to about 74 grams). The lower axial depth of ring 14 results, therefore, in a further reduction in the mass of fan assembly 10 in addition to the reduced mass of the blades 100. The total reduction in the mass of fan assembly 10 for the current example is about 92.7 grams, calculated as the sum of the 7.3 grams reduction in the ring mass plus an 85.4 grams reduction (12.2 grams×7 blades=85.4 grams) in the blade mass.

Consequently, fan assembly 10 has a reduced moment of inertia and it is easier to balance fan assembly 10. The reduced mass of fan assembly 10 also contributes to lower vehicle mass and reduces material costs. Vehicle packaging is also improved because clearances from fan assembly 10 to adjacent engine components or to the heat exchanger are increased in the axial direction.

Although it must have a hub 12, fan assembly 10 need not have a ring 14. The advantageous reduction in the mass of ring 14 provided by the airfoil of blade 100 would be inapplicable, of course, to fan assembly 10 without ring 14. Nevertheless, the airfoil of blade 100 would give ringless fan assembly 10 other advantages (such as packaging) because the airfoil of blade 100 enables a reduced-depth blade (the blade can be set at a lower angle of attack which allows the blade to occupy less axial depth).

The outer ends of blades 100 are joined to ring 14 over the full width of blades 100 and not at a single point or over a narrowing connecting ring 14. This form of connection is important in controlling the circulation of the air from pressure (working) surface 104 to suction surface 102 of blades 100. It also assists in directing the air onto pressure surface 104 of blades 100 with a minimum of turbulence. Finally, the support provided by ring 14 provides strength to blades 100.

Ring 14 also improves fan efficiency. Besides adding structural strength to fan assembly 10 by supporting blades 100 at their tips, ring 14 holds the air on pressure surface 104 of blades 100 and, in particular, prevents the air from flowing from pressure surface 104 to suction surface 102 of blades 100 by flowing around the outer ends of blades 100. Ring 14 preferably has a cross-sectional configuration that is thin in the radial direction while extending in the axial direction a distance at least equal to the axial width of blades 100 at their tips.

A prototype blade 100 using the airfoil described above was built and tested in a fan assembly 10. Thicker airfoil 30, configured relative to the airfoil of blade 100 as shown in FIG. 7 (e.g., having an identical suction surface), was also tested in a similar fan assembly 10. Fan assembly 10 included a hub 12 with a diameter of 130 mm, seven blades (having either the airfoils of blade 100 or thicker airfoils 30), and a rotating ring 14 with a 340 mm inside (tip) diameter. The airflow performance test results showed a high pressure rise with little change in efficiency for the airfoil of blade 100 as compared to thicker airfoil 30.

The performance information listed below in Table I provides data for both the airfoil of blade 100 (the light weight or "Lt. Wt." airfoil) and thicker airfoil 30 (the standard or "Std." airfoil) at different tip pitch setting angles. The tests were conducted at room temperature and performance data correspond to an operating point of 1.4 (non-dimensional)—which represents a vehicle idle condition.

TABLE I

| | Fan Assembly Performance Summary for Typical Idle Operating Conditions | | | | | | | |
|---|---|---|---|---|---|---|---|---|
| | Base | Equal Airflow Performance | | | Equal Speed Performance | | | |
| Airfoil | Std. | Std | Lt. Wt. | Lt. Wt. | Std | Lt. Wt. | Lt. Wt. | Type |
| Pitch | 15.5° | 18.0° | 15.5° | 13.5° | 18.0° | 15.5° | 13.5° | Degree |
| Note | A | B | C | D | B | C | D | |
| Speed | 2000 | 1917 | 1920 | 1974 | 2000 | 2000 | 2000 | RPM |
| Airflow | 24.6 | 24.6 | 24.6 | 24.6 | 25.7 | 25.6 | 24.9 | Cmm |
| Eta | 46.0% | 44.9% | 46.0% | 47.3% | 44.9% | 46.0% | 47.3% | Percent |
| Power | 109.8 | 112.4 | 109.8 | 107.6 | 127.7 | 124.1 | 111.4 | Watts |

The operating point of fan assembly 10 is the combination of airflow through the fan assembly and the pressure rise across the fan assembly; it is essentially the ratio of pressure to airflow including additional factors to provide non-dimensionalization. Higher value operating points indicate higher pressure rise and lower airflow operation. Lower values indicate higher airflow rates through, and lower pressure rise across, fan assembly 10.

The non-dimensional operating range for typical automotive engine-cooling fan assemblies includes values between about 0.7 to 1.5. Idle operation is the most important point for fan assembly performance. Typical idle operating points range from 1.3 to 1.5. Thus, this range of fan assembly operation is most important for performance evaluation of the fan assembly.

The "pumping" performance of fan assembly 10 is defined as the speed that fan assembly 10 must turn to deliver a given airflow performance. Pumping, or the flow to speed ratio, changes as a function of pressure rise and flow operation point of fan assembly 10. It is desirable to have a fan assembly 10 with both high pumping and high operation efficiency (eta, $\eta$). Comparisons of performance between fan assemblies must be made taking into account differences in both pumping and efficiency performance.

The "baseline" data point (Note A in Table I) for comparison to the airfoil of blade 100 is thicker airfoil 30 with a tip pitch setting angle of 15.5°. Thicker airfoil 30 was also tested at an 18° tip pitch setting angle (Note B in Table I)—although the airfoil pitch angle twist distribution across the blade span from tip to hub was unchanged from the baseline design. The setting angle of the entire blade section was adjusted. This test condition is included to show the performance of thicker airfoil 30 at a higher pumping regime.

Fan assembly 10 having blades 100 with the airfoils of the present invention was tested at a blade tip pitch setting angle (of 15.5°) identical to the baseline test (Note C in Table I). This test condition shows the impact of the airfoil of blade 100 when compared to thicker airfoil 30. This test condition also matches the pumping of thicker airfoil 30 at the higher (18°) pitch angle. Finally, fan assembly 10 having the airfoil of blades 100 was tested at a blade tip pitch setting angle of 13.5° (Note D in Table I). This test condition delivers equivalent airflow performance to thicker airfoil 30 but at a reduced pitch angle.

The data provided above in Table I show that the airfoil of blade 100, tested at the same pitch (15.5°) as thicker airfoil 30, has the same efficiency (46.0%) and airflow performance (24.6 Cmm) ("Cmm" represents cubic meters per minute) but better pumping (1920 versus 2000 RPM). The pumping of fan assembly 10 with thicker airfoil 30 at 18° essentially matches (about 1920 RPM) that with the airfoil of blade 100 at 15.5°, but has lower efficiency (44.9% versus 46.0%). Thus, ring 14 of fan assembly 10 has a lower axial depth with the airfoil of blade 100 than with thicker airfoil 30 at similar pumping. Finally, the airfoil of blade 100 at a 13.5° pitch and with a ring 14 of lower axial depth delivers superior efficiency and pumping performance compared to thicker airfoil 30 at a 15.5° pitch.

Figure 10:
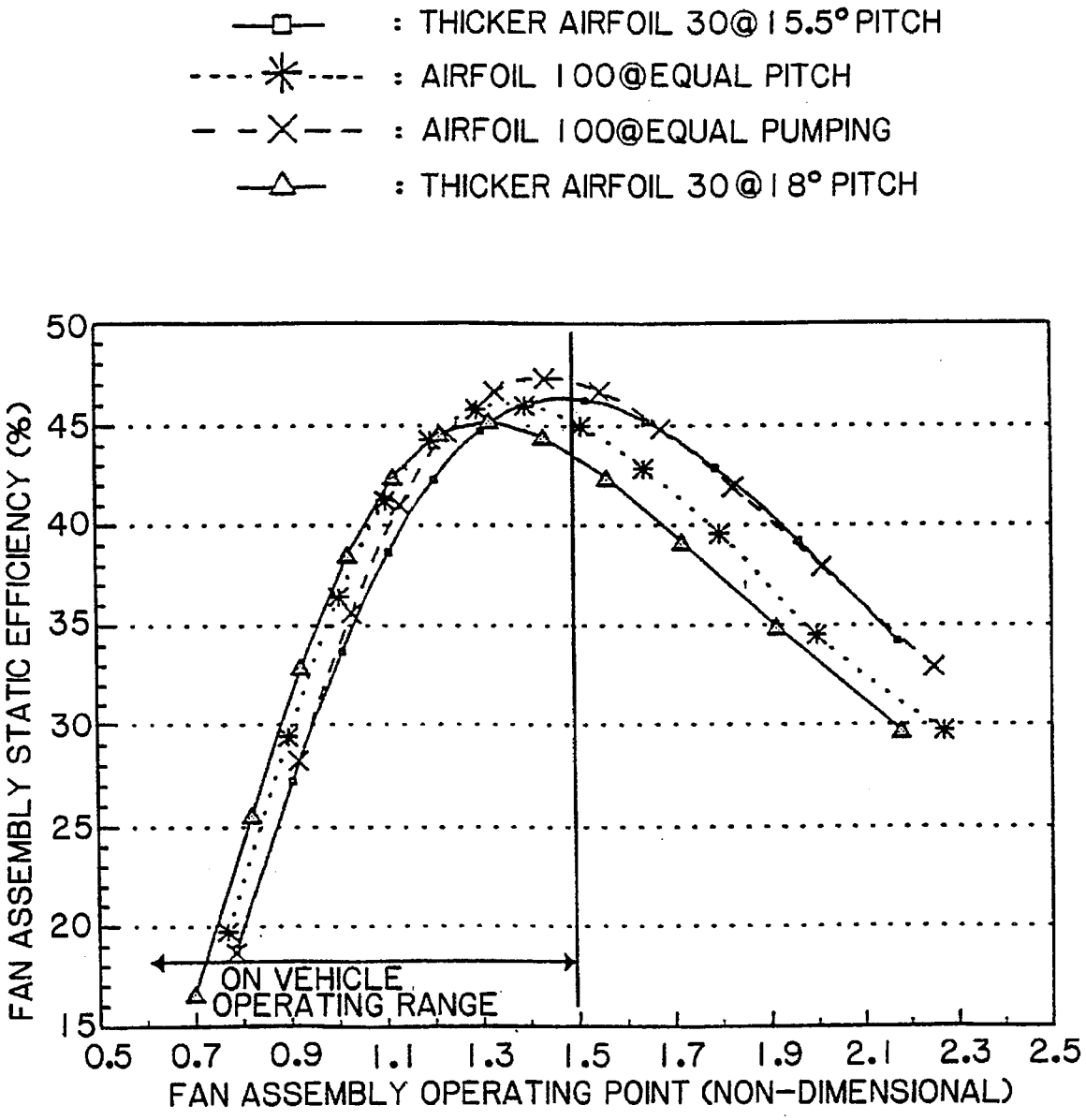
FIG. 10 is a graph of fan assembly static efficiency versus fan assembly operating point, comparing the airfoil of the blade of the present invention, shown in FIG. 6, with the conventional thicker airfoil, shown in FIG. 3*a;*

FIG. 10 is a graph of fan assembly static efficiency versus fan assembly operating point. The typical operating range of 0.7 to 1.5 for automotive cooling fan assemblies is indicated on the graph. The area of primary interest is in the operating range from 1.3 to 1.5, which represents idle operation. Four curves are provided, one each for thicker airfoil 30 at a pitch of 15.5°, the airfoil of blade 100 at an equal pitch of 15.5°, the airfoil of blade 100 which matches the pumping of thicker airfoil 30 at a pitch of 15.5° , and thicker airfoil 30 at a higher pitch of 18°. Inspection of the graph in FIG. 10 shows the improved efficiency within the idle range of interest for the airfoil of blade 100 when compared to standard, thicker airfoil 30 with equal pumping.

In summary, the fan assembly performance test results provided above evidence increased pumping using the airfoil of the present invention without significant loss in fan assembly efficiency. The increased pumping is due to the higher lift provided by the improved airfoil. A substantially equivalent efficiency performance combined with increased pumping indicates that lift has increased in greater proportion to drag. In other words, the airfoil of blade 100 provides a higher lift-to-drag ratio than conventional, thicker airfoil 30.

Figure 4A:
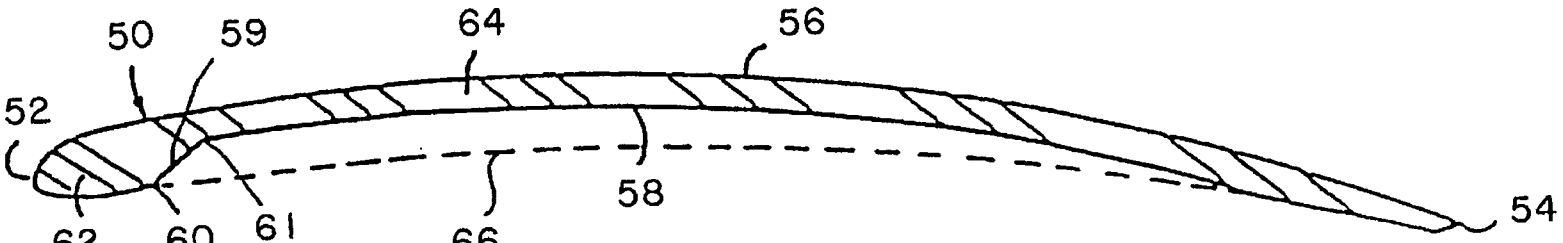
FIG.4a (PRIOR ART)
FIG. 4*a* is a cross-sectional view of a prior art ARMC airfoil.
Figure 4B:
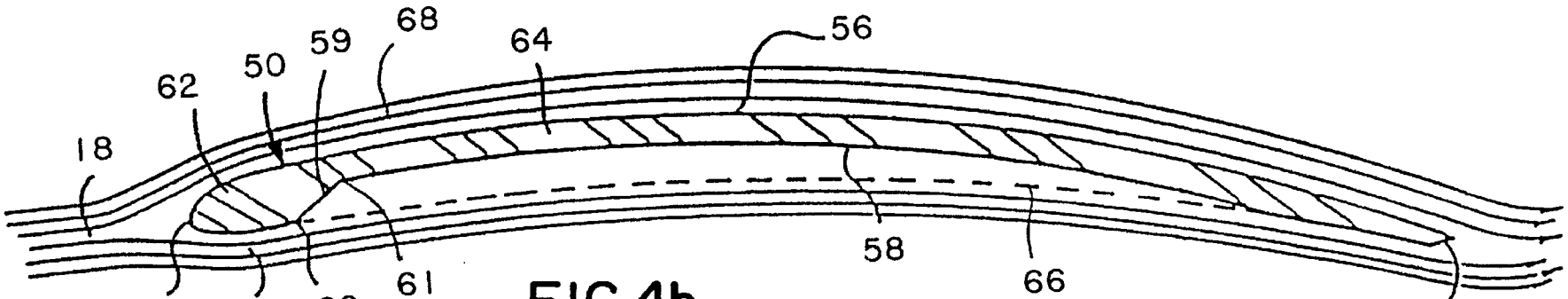
FIG.4b (PRIOR ART)
FIG. 4*b* illustrates the ARMC airfoil, shown in FIG. 4*a*, in an airstream.
Figure 11:
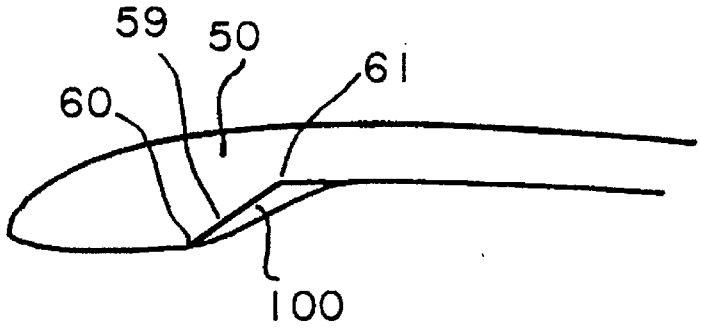
FIG. 11 is an overlay of the prior art ARMC airfoil, shown in FIG. 4*a*, on the airfoil of the blade of the present invention, shown in FIG. 6.

Turning to a comparison between the airfoil according to the present invention and ARMC airfoil 50, FIG. 11 highlights the difference in profile between the two airfoils. FIG. 11 is an overlay of ARMC airfoil 50 on the airfoil of blade 100. ARMC airfoil 50, with its sharp corners 60 and 61 defining straight line portion 59 on pressure surface 58 (see FIG. 4*a*), seeks to duplicate the flow over thicker airfoil 30. In contrast, the airfoil of blade 100 assures attached air flow on pressure surface 104 by a smooth blend between rounded, thick, bulbous nose section 110 and thin, highly-cambered aft section 112 (see FIG. 6). Because the airfoil of blade 100 maintains attached flow in this region of pressure surface 104, the designer can take advantage of the increased camber of the airfoil of blade 100, which, as mentioned earlier, produces increased lift.

Figure 4C:
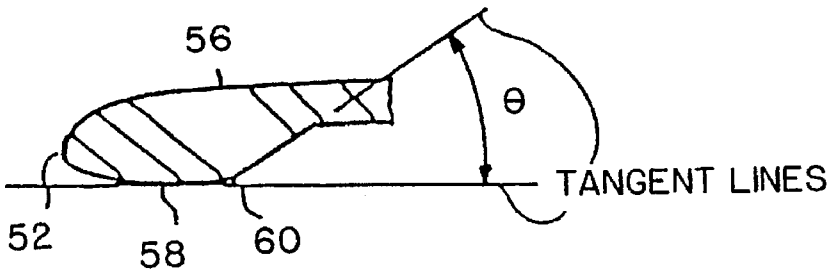
FIG.4c (PRIOR ART)
FIG. 4*c* is an enlarged view of a section of the ARMC airfoil shown in FIG. 4*a;*
Figure 12:
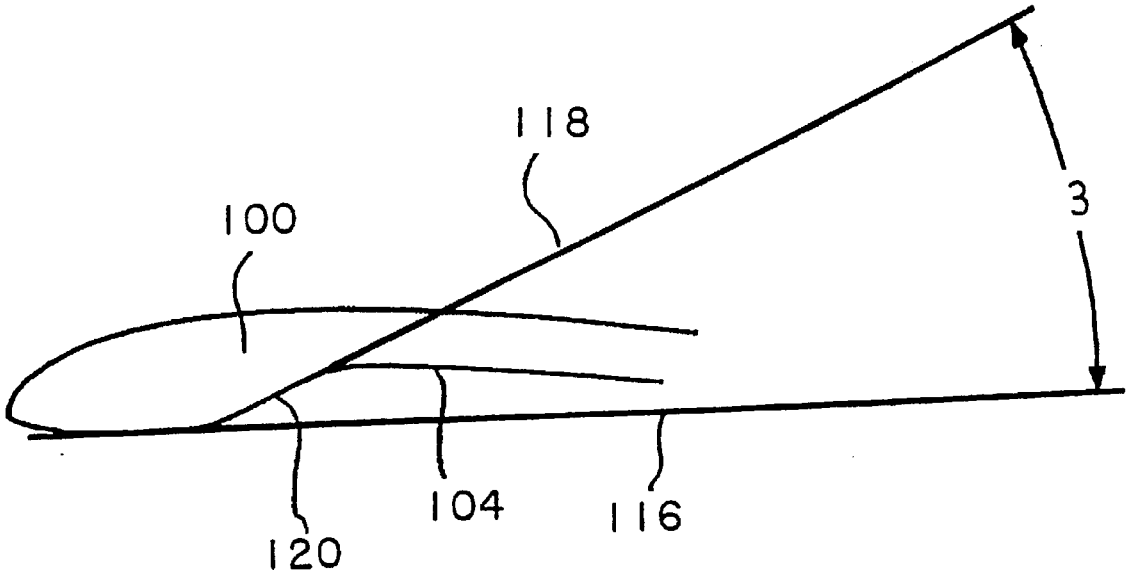
FIG. 12 is an enlarged view of a section of the airfoil of the blade of the present invention shown in FIG. 6.

Referring to FIG. 4*c*, first sharp corner 60 bends at an angle θ of at least 30°. In FIG. 12, the airfoil of blade 100 is shown with a first line 116 tangent to nose section 110 on pressure surface 104 and a second line 118 tangent to the mid-point of the gradual (not sharp) transition region 120. The resulting angle, β, between tangent lines 116 and 118 is only 24.1°—significantly less than the 30° angle of ARMC airfoil 50. Although it may vary as a function of chord, camber, and other characteristics of different airfoils, the angle β is between 20° and 28°.

Figure 5:
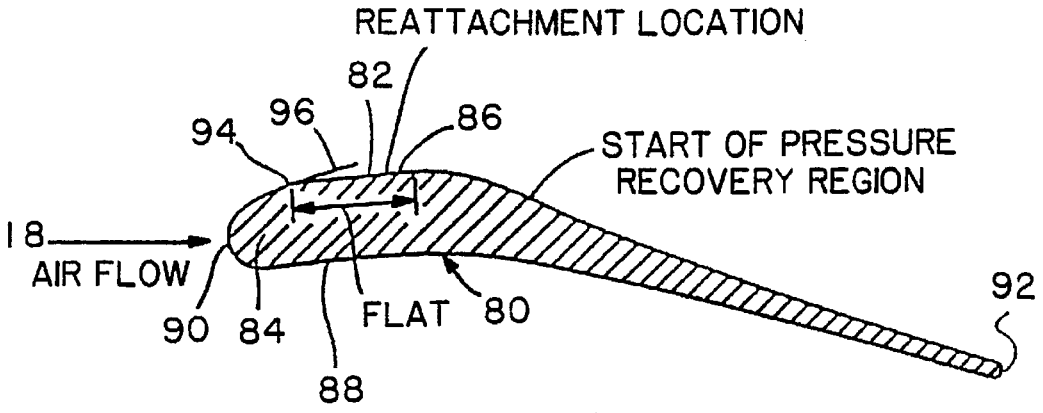
FIG. 5 (PRIOR ART)
FIG. 5 is a cross-sectional view of a conventional discontinuous airfoil.
Figure 13:
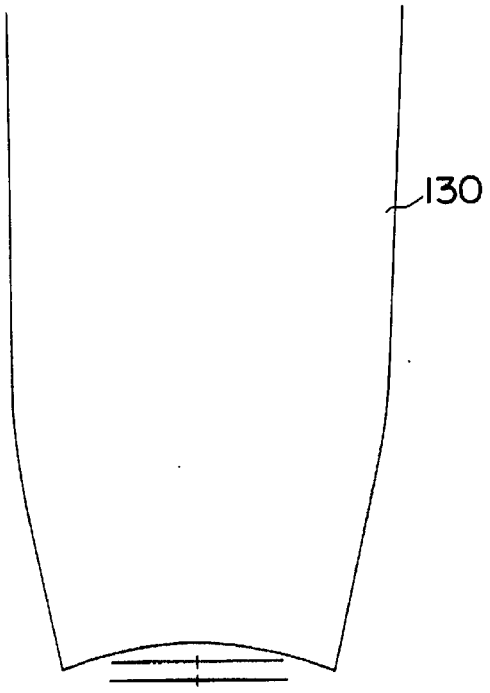
FIG. 13 (PRIOR ART)
FIG. 13 illustrates a blade with a conventional, straight planform.

Discontinuous airfoil 80 with a flat 82 (see FIG. 5) provides excellent performance across a wide operating range as a blade with a straight planform. FIG. 13 illustrates a blade with a straight planform 130. Environmental concerns have prompted, however, replacement of the chlorinated fluorocarbon-containing refrigerants (such as R12) used in automotive air conditioning systems with non-CFC-containing refrigerants (such as R134*a*). The non-CFC refrigerants are less effective than the refrigerants they replace and require increased fan assembly airflow rates to provide performance equivalent to the CFC-containing refrigerants.

Figure 14A:
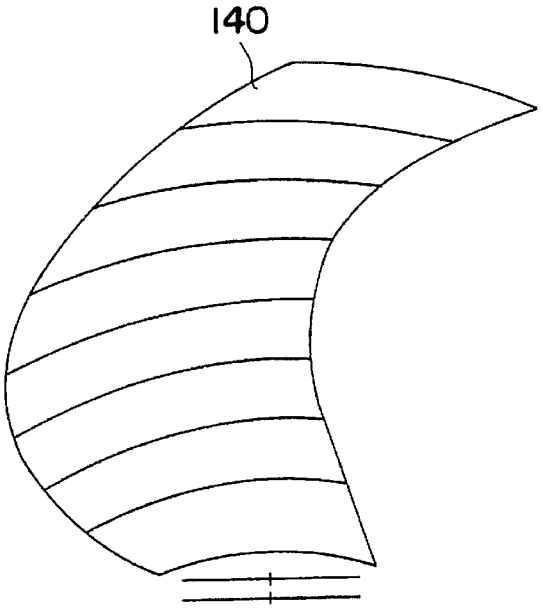
FIG. 14*a* illustrates a blade with a highly-curved blade planform.

If the existing, straight-bladed fan assemblies were used in the non-CFC-containing air conditioning systems, the assemblies would have to operate at higher speeds—thus causing increased airborne noise. Therefore, a highly-curved blade planform 140 has been used, as shown in FIG. 14*a*, to provide the air-moving performance required by the new air conditioning systems with acceptably low noise levels. On the new, backward-curved blades used in the air conditioning systems without CFCs, however, discontinuous airfoil 80 is not as effective as the airfoil of blade 100 with a smooth, continuous suction surface.

Other aspects of vehicle design, besides the switch to non-CFC-containing air conditioning systems, have prompted the use of high-pumping, high-efficiency blades with platform 140. These aspects include styling (with closed front ends, smaller grilles, and the like) that increases the system restriction, the need for increased electrical efficiency which requires more efficient fan assemblies, reduced packaging space, reduced noise, and reduced mass. The airfoil of blade 100 with highly-curved blade platform 140 addresses all of these design aspects.

Figure 14B:
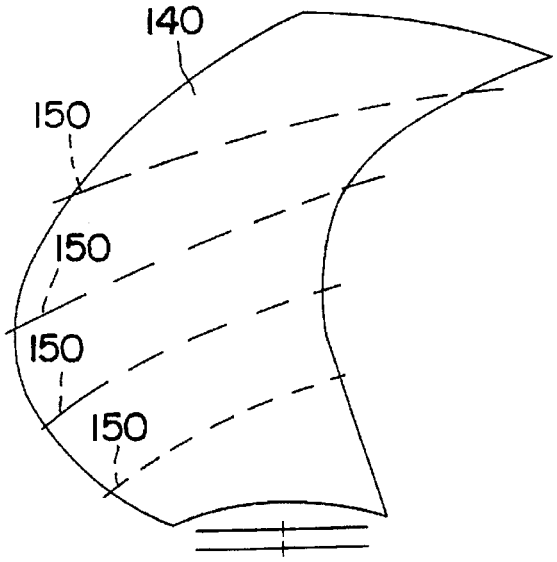
FIG. 14*b* shows the streamlines of the complex, three-dimensional flowfield over the highly-curved blade planform illustrated in FIG. 14*a;*

The highly-curved blade planform 140 produces a complex, three-dimensional flowfield 150 over the blade surface. The streamlines of such a flowfield 150 are illustrated in FIG. 14*b*. The resulting streamlines do not traverse the blade along a constant radius; rather, the streamlines tend to increase in radius from the fan inlet to exit. This radial movement of the flow makes it difficult to design a low-Reynolds-number airfoil such as discontinuous airfoil 80. The radial shifting of the streamlines, shown in FIG. 14*b*, results in an effective airfoil that is quite different from one designed for a constant-radius airflow.

In contrast, the airfoil of blade 100 of the present invention with highly-curved blade planform 140 has been successfully tested. The successful operation of the airfoil of blade 100 on the backward-curved blade is achieved by the following design features: a generous leading edge radius (which allows the flow to remain attached to suction surface 102 over a range of incidence angles) and high camber (which provides increased lift and pumping). The sculpted pressure surface 104 maintains the positive performance achieved by these design features, while at the same time reducing fan assembly mass and cost. Thus, unlike discontinuous airfoil 80, the airfoil of blade 100 is suitable for blades with swept or straight planforms.

Figure 15:
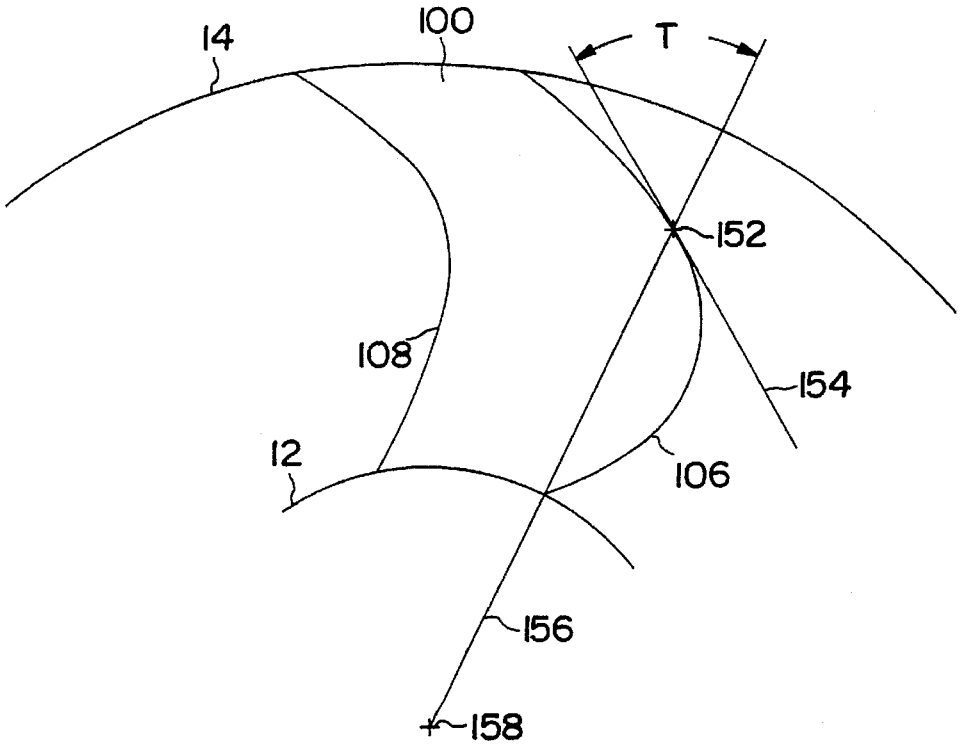
FIG. 15 illustrates the skew angle for measuring the magnitude of the planform curvature of the blade of the present invention.

In addition to the airfoil discussed above, blade 100 of the present invention is also provided with a unique, skewed or curved planform to increase fan performance. The skew refers to the curvature of leading edge 106 of blade 100 and is illustrated in FIG. 15. At an arbitrary point 152 on leading edge 106 of blade 100, the skew angle is the angle "T" between a tangent 154 to leading edge 106 through point 152 and a line 156 from the center 158 of hub 12 (and the center of fan assembly 10) through point 152. The magnitude of skew or planform curvature is defined by the skew angle, T.

Figure 16:
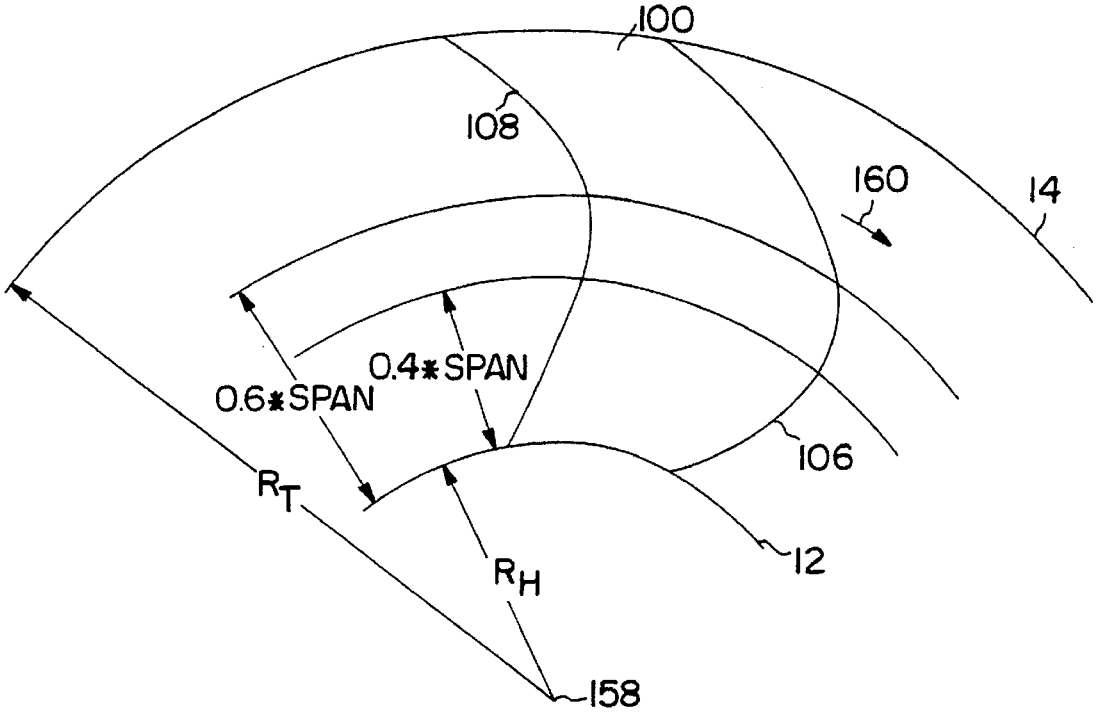
FIG. 16 shows the blade having a planform with regions of forward, straight, and backward curvature according to the present invention.

The planform of blade 100 is a composite of three regions having different planform shapes. The planform is shown in FIG. 16. The span of blade 100 is defined as $R_T$–$R_H$, where $R_T$ is the tip radius and $R_H$ is the hub radius. For the lower 40% of the span from hub 12 to ring 14, blade 100 has forward curvature: leading edge 106 is curved toward the direction of rotation (arrow 160). The platform of blade 100 has little or no curvature (i.e., straight curvature) in the interior 20% of the blade span. At the outermost 40% of the span, blade 100 has backward curvature: leading edge 106 is curved away from the direction of rotation.

This combination of planform curvature is not arbitrary. The planform shape was chosen after comparing fan performance data for three separate blades: one forward-curved, one straight, and one backward-curved. One important variable in fan design is pressure rise across the fan (from inlet to outlet plane).

Figure 17:
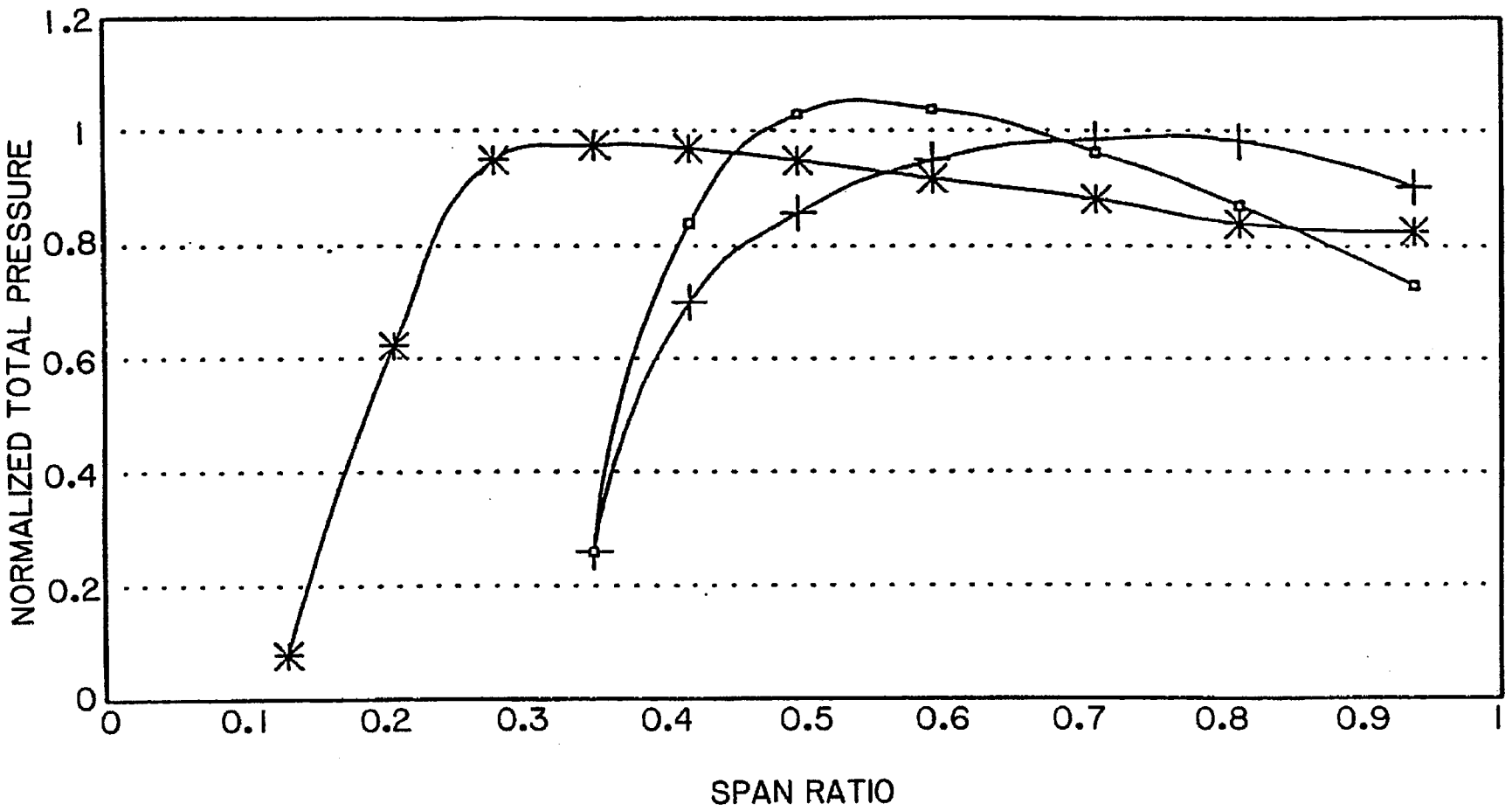
FIG. 17 is a graph of normalized total pressure versus span ratio for blades with forward, straight, and backward curvature.

In FIG. 17, normalized total pressure is plotted versus span ratio. The span ratio is defined as $(R-R_H)\div(R_T-R_H)$, where r is the local radius. The data show that the most uniform normalized pressure rise is achieved with a combination of blade planforms. The forward-curved blade has the highest pressure rise from the hub to about 40% of span; the straight planform performs best in the interior 20% of span; and the backward-curved blade has the greatest pressure rise in the outer 30% to 40% of span-near the tip of the blade. Because each blade demonstrated superior performance in a given region of the blade span, blade 100 was designed with forward curvature in the lower 40% of span, little or no curvature in the interior 20%, and backward curvature in the upper 40% of the span. The planform of blade 100 is illustrated in FIG. 16.

Although the dimensions of blade 100 incorporated in fan assembly 10 will vary depending upon the application of fan assembly 10, the dimensions discussed above describe a preferred form of the invention suitable for use in a number of automotive applications.

A blade with planform curvature produces lower airborne noise than a blade with a straight planform. Even with the optimized pressure loading of blade 100 described above, however, there is still a drop in net airmoving performance associated with the curved planform blade. This performance loss is the result of the downwash that exists on any swept wing or blade. Downwash is the term used to describe the upstream tangential velocity component that is induced by trailing-edge vortices. This induced tangential velocity reduces the airfoil's effective angle of attack and, consequently, reduces lift and blade pumping.

Figure 18A:
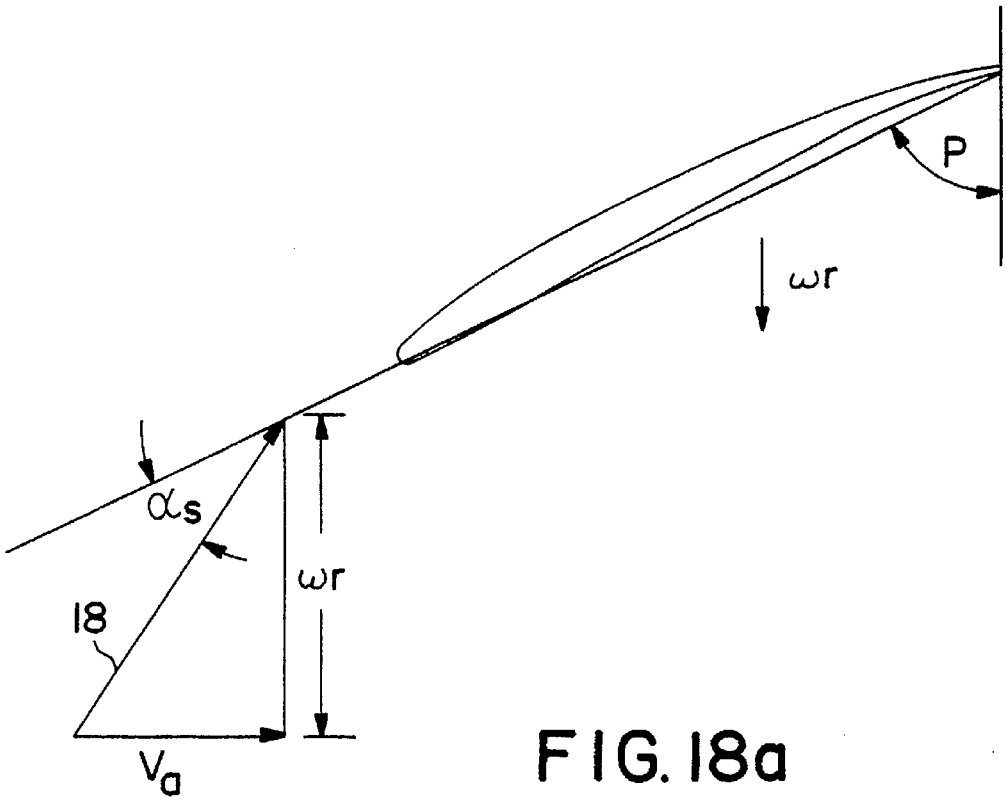
FIG. 18*a* illustrates a typical inlet velocity diagram for an airfoil of a blade with a straight planform.
Figure 18B:
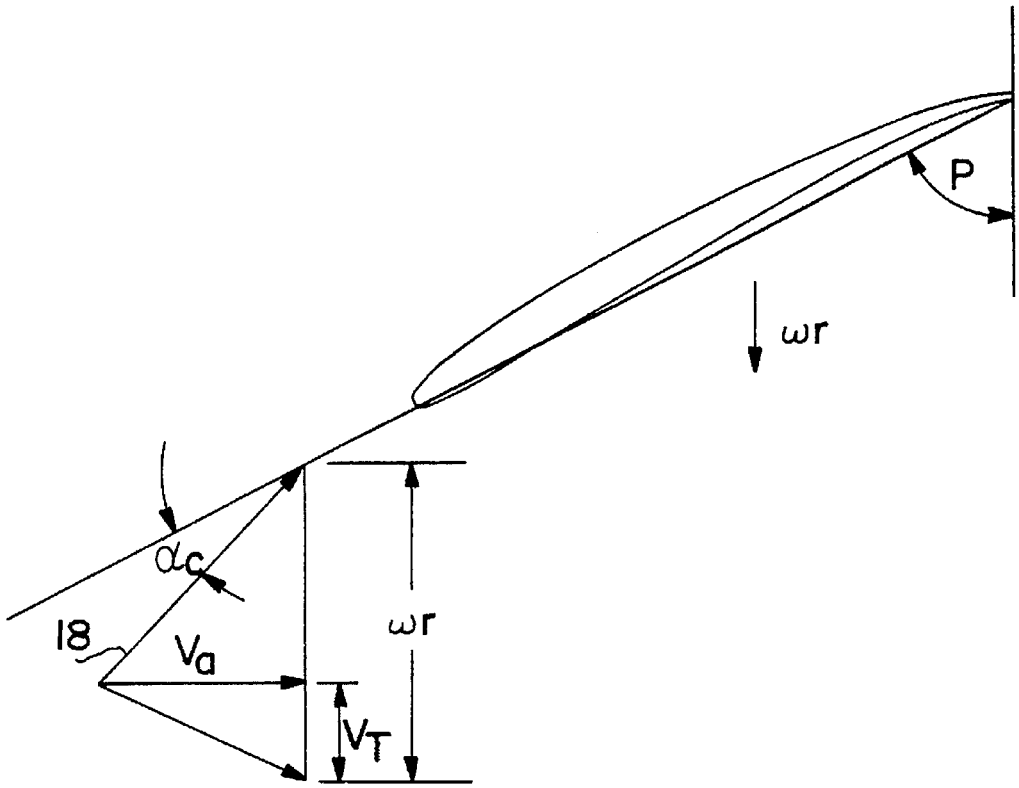
FIG. 18*b* illustrates a typical inlet velocity diagram for an airfoil of a blade with a curved planform.

Typical inlet velocity diagrams for an airfoil of a blade with a straight planform and for an airfoil of a blade with a curved planform are shown in FIGS. 18*a* and 18*b*, respectively. In each case, "P" is the pitch angle of the blade. The linear blade speed is represented by $\omega r$, where $\omega$ is the angular speed of the blade and r is the radius. In an axial flow fan assembly 10, the air flow has components of velocity parallel to the axis of rotation of fan assembly 10 ($v_a$) and to the tangential direction ($v_T$)—but has little radial velocity. The angle of attack ($\alpha$) for air stream 18 is represented by $\alpha_s$ for the straight planform blade (FIG. 18*a*) and by $\alpha_c$ for the curved planform blade (FIG. 18*b*). Note that $\alpha_c<\alpha_s$.

Several alternatives exist for recovering the airfoil performance lost to downwash on curved planform blades. One solution is to operate the fan assembly having curved planform blades at a higher speed to match the airflow of the straight planform blades. This alternative is undesirable because the noise increases at the higher speed. Another option is to increase the pitch angles of the airfoils, which will increase pumping and deliver the required flow without an increase in speed. Although this option will not increase the fan noise, a deeper fan package is required because the fan depth is a function of airfoil pitch expressed by:

$$D(r)=C(r)*\sin(P(r)) \quad (1)$$

where D(r) is the blade depth at radius r, C(r) is the airfoil chord, and P(r) is the airfoil pitch angle as shown in FIGS. 18*a* and 18*b*. With the restriction in available underhood space in modern automobiles, it is important to keep the depth D as small as possible.

Another alternative is to increase the chord length C. This alternative will increase the lift of the airfoil and the pumping that the blade can produce. An increase in chord C(r) produces an increase in depth D(r), however, as given in equation (1) above.

A fourth approach is to modify the design of the airfoil itself to create more lift (and, thereby, more pumping) without increasing the airfoil pitch angle or chord. As mentioned above, airfoil lift increases with increased camber. To produce equivalent lift with a cambered airfoil, the pitch angle of the airfoil can be reduced. This is shown in FIG. 8, which is a graph of Coefficient of Lift ($C_L$) versus Angle of Attack ($\alpha$) for an airfoil with higher and lower camber.

Figure 19:
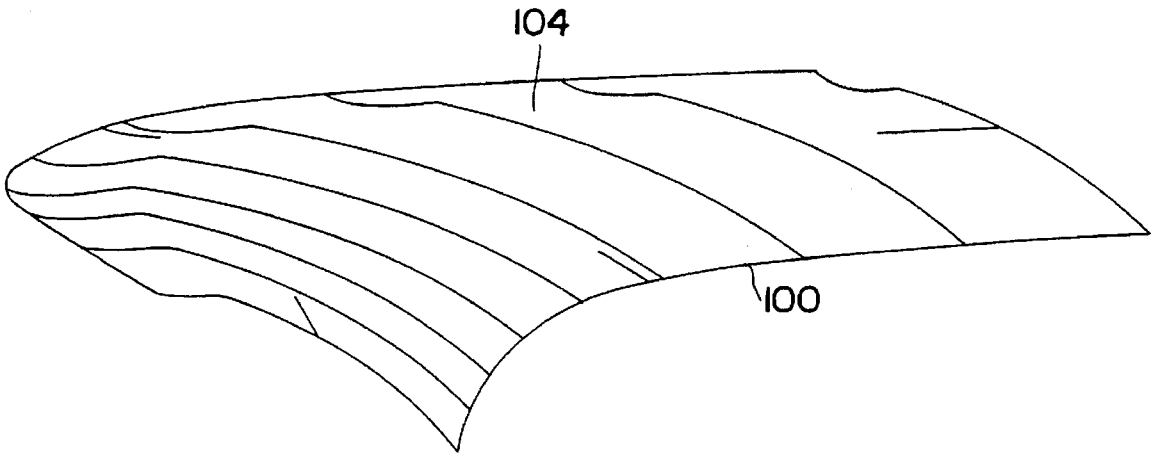
FIG. 19 shows the pressure surface of the blade—combining the high-lift airfoil having a bulbous leading edge shown in FIG. 6 with the 40% forward curvature, 20% straight, 40% backward curvature planform from hub to ring shown in FIG. 16—according to the present invention.

Pressure surface 104 of blade 100 combining the high-lift airfoil and curved planform is illustrated in FIG. 19. By providing a blade 100 with the high-lift airfoil having a bulbous leading edge (see FIG. 6) and with the 40% forward curvature, 20% straight, 40% backward curvature planform from hub 12 to ring 14 (see FIG. 16), reduced noise and proper loading of blades 100 are achieved. Fan assembly 10 having blades 100 also has a good operating efficiency. These operational improvements are achieved through a combination of both the high-lift airfoil and curved planform features of blade 100.

Test results validate the improvement in operation. Three types of prototype blades were built and tested in fan assembly 10 for comparison. The first blade (Blade 1) has a straight planform and the conventional thicker airfoil 30 shown in FIG. 3*a*. Blade 1 provides a baseline. The second blade (Blade 2) has the same airfoil as Blade 1, but has the 40%-20%-40% curved planform described above and shown in FIG. 16. The third blade (Blade 3) has both the high-lift airfoil with a bulbous leading edge, as described above and shown in FIG. 6, and the 40%-20%-40% curved planform. Equal airflow performance was chosen as the basis for comparison: fan speed was adjusted to match the volume flow rate of the Blade 1 fan at 15° tip pitch angle at a speed of 1850 RPM. Results are shown in Table II below:

TABLE II

| | Equal-Airflow Comparison | | |
|---|---|---|---|
| | Blade 1 (straight planform; standard airfoil) | Blade 2 (curved planform; standard airfoil) | Blade 3 (curved planform; high-lift airfoil) |
| Eff, % | 45.4 | 48.0 | 46.9 |
| Speed, RPM | 1850 | 1954 | 1914 |
| Noise, dB (A) | 75.6 baseline performance | 72.9 same pitch as Blade 1 | 72.2 same pitch as Blade 1 |

Test results show that blade planform curvature alone results in a 2.7 dB(A) noise reduction, but requires an additional 104 RPM to match the baseline airflow performance (Blade 1 versus Blade 2).

To recover lost airflow while maintaining the noise reduction of the curved planform blade, Blade 3 was built with both planform curvature and the high-lift, bulbous-leading-edge- airfoil. Blade 3 required a speed of 1914 RPM to match baseline performance and provided a noise level of 72.7 dB(A). For Blade 3 to match the baseline airflow at a speed of 1850 RPM, the pitch angle must me increased from 15° to 17.5°. For Blade 2 to match baseline airflow at 1850 RPM, the pitch angle must be increased from 15° to 19°.

Note that even at the higher fan speeds required for Blades 2 and 3 to match the baseline (straight planform) airflow of Blade 1, the noise generated by these curved planform blades is lower. In the case of Blade 2 (curved planform, standard airfoil), the noise is 2.7 dB(A) lower than Blade 1; Blade 3 is 3.4 dB(A) quieter than Blade 1 at the equal-airflow operating speed.

The advantage of using the high-lift airfoil is shown by comparing Blade 2 with Blade 3. To match the straight planform blade airflow at 1850 RPM, Blade 2 standard airfoil) required an increase in pitch angle of 4°. Blade 3, with the highly-cambered high-lift airfoil, required an increase in pitch angle of only 2.5°. The 1.5° of decreased blade pitch (Blade 3 versus Blade 2), on a blade with a tip chord of 56.0 mm, would result in a 5% decrease in ring axial depth. This corresponds to a mass decrease of 5.0 g (assuming a 1.4 mm decrease in ring depth, thickness of 2.5 mm, ring radius of 161.25 mm, and the density of Nylon 6/6 of 1.42 grams per cubic centimeter).

The decrease in the axial depth of ring 14 may be leveraged in one of two ways: fan assemble 10 could be pulled forward, away from the engine, thus increasing clearance between fan assembly 10 and underhood components; or, fan assembly 10 could be pulled rearward, away from the heat-exchanger face, thus improving the ability of shrouded fan assembly 10 to draw air from the corners of the heat exchanger. In either case, the decreased axial depth of fan assembly 10 works to the advantage of the engine-cooling system designer. The extremely tight packaging in the underhood of modern vehicles makes even this small improvement in the axial depth of fan assembly very important.

Moreover, the mass of Blade 3 (curved planform, high-lift airfoil) is 9.3 g less than the mass of Blade 2 (curved planform, standard airfoil). This is a 34% reduction in blade mass compared with the conventional thick-airfoil blade.

Blade 100 can have either of the two, separate characteristics (curved planform and high-lift airfoil) discussed above. Preferably, however, blade 100 has both characteristics. Blade 100 with the combination of three planform shapes discussed above produces low airborne noise with a uniform spanwise pressure loading. To compensate for the reduced pumping that is a consequence of curving the blade planform, a special high-lift airfoil is used. The combination of the curved planform and high-lift airfoil gives fan assembly 10 the required airmoving performance.

Blade 100 with a curved planform and high-lift airfoil results in a near-uniform span-wise pressure loading with high efficiency, low airborne noise, and low mass. The unique airfoil operates at a lower angle of attack than a conventional thick airfoil, which results in less ring and blade axial depth and an associated decrease in axial packaging space. The reduction in fan and ring axial depth (compared with a curved blade with conventional thick airfoils) allows for easier packaging and better airflow through the heat exchanger.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention. The engine-cooling fan assembly in which the airfoil of the present invention is incorporated, for example, may be powered by a fan clutch, an electric motor, or an hydraulic motor and may be used with or without an attached rotating ring.

What is claimed is:

1. A planform defining the shape of blades of a vehicle engine-cooling fan assembly, each blade having a root, a tip, and a span between the root and tip, said planform comprising:

a first region adjacent the root of the blade having forward curvature;

a second region adjacent the tip of the blade having backward curvature; and an intermediate region disposed between said first region and said second region having substantially straight curvature.

2. The planform according to claim 1 wherein said first region having forward curvature extends from the root to a terminus located about forty-percent of the span of the blade.

3. The planform according to claim 2 wherein said intermediate region having substantially straight curvature extends from said terminus of said first region to an end point located about sixty-percent of the span of the blade and said second region having backward curvature extends from said end point of said intermediate region to the tip of the blade.

4. The planform according to claim 1 wherein said second region having backward curvature extends from the tip to an end point of said intermediate region located between about sixty and seventy-percent of the span of the blade.

5. A vehicle fan assembly for circulating air to cool an engine, said fan assembly comprising:

a central hub; and a plurality of blades with a planform, a root joined to said hub, a tip, and a span between said root and said tip, said blades extending generally radially outward from said hub and each said planform having:

(a) a first region adjacent said root of said blade with forward curvature;

(b) a second region adjacent said tip of said blade with backward curvature; and p2 (c) an intermediate region disposed between said first region and said second region with substantially straight curvature.

6. The vehicle fan assembly according to claim 5 further comprising an outer ring, said blades extending generally radially outward from said hub to said ring.

7. The vehicle fan assembly according to claim 6 wherein said ring has an axial depth of about 23 mm.

8. The vehicle fan assembly according to claim 5 wherein said first region with forward curvature extends from said root to a terminus located about forty-percent of said span of said blade.

9. The vehicle fan assembly according to claim 8 wherein said intermediate region with substantially straight curvature extends from said terminus of said first region to an end point located about sixty-percent of said span of said blade and said second region with backward curvature extends from said end point of said intermediate region to said tip of said blade.

10. The vehicle fan assembly according to claim 5 wherein said second region with backward curvature extends from said tip to an end point of said intermediate region located between about sixty and seventy-percent of said span of said blade.

11. A blade for a vehicle engine-cooling fan assembly comprising:

a root;

a tip;

a span between said root and said tip;

a planform having:

(a) a first region adjacent said root of said blade with forward curvature.

(b) a second region adjacent said tip of said blade with backward curvature, and (c) an intermediate region disposed between said first region and said second region with substantially straight curvature; and an airfoil section having:

(a) a leading edge, (b) a rounded, bulbous nose section adjacent said leading edge, (c) a trailing edge, (d) a curved pressure surface extending smoothly and without discontinuity from said nose section to said trailing edge, (e) a curved suction surface extending smoothly and without discontinuity from said nose section to said trailing edge, and (f) a thin, highly cambered aft section formed adjacent said trailing edge and between said pressure surface and said suction surface, said aft section having a location of maximum camber, said nose section having a thickness which is greater than the thickness of said airfoil section between said pressure surface and said suction surface and said nose section blending smoothly into said pressure surface and said suction surface.

12. The blade according to claim 11 wherein said first region with forward curvature extends from said root to a terminus located about forty-percent of said span of said blade.

13. The blade according to claim 12 wherein said intermediate region with substantially straight curvature extends from said terminus of said first region to an end point located about sixty-percent of said span of said blade and said second region with backward curvature extends from said end point of said intermediate region to said tip of said blade.

14. The blade according to claim 11 wherein said second region with backward curvature extends from said tip to an end point of said intermediate region located between about sixty and seventy-percent of said span of said blade.

15. A vehicle fan assembly for circulating air to cool an engine, said fan assembly comprising:

a central hub; and a plurality of blades, each blade having:

(a) a root, (b) a tip, (c) a span between said root and said tip, (d) a planform including:

(1) a first region adjacent said root of said blade with forward curvature:

(2) a second region adjacent said tip of said blade with backward curvature; and (3) an intermediate region disposed between said first region and said second region with substantially straight curvature, and (e) an airfoil section including:

(1) a leading edge;

(2) a rounded, bulbous nose section adjacent said leading edge;

(3) a trailing edge;

(4) a curved pressure surface extending smoothly and without discontinuity from said nose section to said trailing edge;

(5) a curved suction surface extending smoothly and without discontinuity from said nose section to said trailing edge; and (6) a thin, highly cambered aft section formed adjacent said trailing edge and between said pressure surface and said suction surface, said aft section having a location of maximum camber, said nose section having a thickness which is greater than the thickness of said airfoil section between said pressure surface and said suction surface and said nose section blending smoothly into said pressure surface and said suction surface.

16. The vehicle fan assembly according to claim 15 further comprising an outer ring, said blades extending generally radially outward from said hub to said ring.

17. The vehicle fan assembly according to claim 16 wherein said ring has an axial depth of about 23 mm.

18. The vehicle fan assembly according to claim 15 wherein said first region with forward curvature extends from said root to a terminus located about forty-percent of said span of said blade.

19. The vehicle fan assembly according to claim 18 wherein said intermediate region with substantially straight curvature extends from said terminus of said first region to all end point located about sixty-percent of said span of said blade and said second region with backward curvature extends from said end point of said intermediate region to said tip of said blade.

20. The vehicle fan assembly according to claim 15 wherein said second region with backward curvature extends from said tip to an end point of said intermediate region located between about sixty and seventy-percent of said span of said blade.

* * * * *